US010060440B2

(12) United States Patent
Fujimoto et al.

(10) Patent No.: US 10,060,440 B2
(45) Date of Patent: Aug. 28, 2018

(54) CENTRIFUGAL FAN

(71) Applicant: MINEBEA CO., LTD., Kitasaku-gun, Nagano (JP)

(72) Inventors: Seiya Fujimoto, Nagano (JP); Takako Otsuka, Nagano (JP); Yuzuru Suzuki, Nagano (JP); Masaki Ogushi, Nagano (JP)

(73) Assignee: Minebea Co., Ltd., Nagano (JP)

( * ) Notice: Subject to any disclaimer, the term of this patent is extended or adjusted under 35 U.S.C. 154(b) by 187 days.

(21) Appl. No.: 14/933,331

(22) Filed: Nov. 5, 2015

(65) Prior Publication Data

US 2016/0053773 A1 Feb. 25, 2016

Related U.S. Application Data

(63) Continuation of application No. 13/517,655, filed on Jun. 14, 2012, now Pat. No. 9,194,398.

(30) Foreign Application Priority Data

Jul. 25, 2011 (JP) ..... 2011-162326

(51) Int. Cl.
*F04D 29/42* (2006.01)
*F04D 17/16* (2006.01)
(Continued)

(52) U.S. Cl.
CPC ..... *F04D 29/4246* (2013.01); *F04D 17/16* (2013.01); *F04D 25/0613* (2013.01); *F04D 29/281* (2013.01)

(58) Field of Classification Search
CPC ..... F01D 17/16; F04D 29/42; F04D 29/4261; F04D 29/281; F04D 25/0613
See application file for complete search history.

(56) References Cited

U.S. PATENT DOCUMENTS 5,813,831 A 9/1998 Matsunaga et al.
6,503,055 B1 1/2003 Gerenski et al.
(Continued)

FOREIGN PATENT DOCUMENTS

JP 9-242696 A 9/1997
JP 2002-195197 A 7/2002
(Continued)

OTHER PUBLICATIONS

Office Action dated Jul. 19, 2016 in the corresponding Japanese Patent Application No. 2015-212321.

*Primary Examiner* — Woody Lee, Jr.
*Assistant Examiner* — Maxime Adjagbe
(74) *Attorney, Agent, or Firm* — Carrier Blackman & Associates, P.C.; Joseph P. Carrier; Jeffrey T. Gedeon

(57) ABSTRACT

A centrifugal fan includes: a casing having an upper casing with an air suction opening, a lower casing, and a plurality of support members disposed between the lower casing and the upper casing with air discharge openings provided between the support members; an impeller disposed between the upper and lower casings, and including an annular upper shroud provided on an upper casing side, a base plate integrally formed with the annular upper shroud, and a plurality of blades arranged along a circumferential direction between the annular upper shroud and the base plate; and a fan motor which rotates the impeller. A plurality of recesses are provided on the upper surface of the upper casing, and formed to surround the air suction opening, and a plurality of ribs are radially provided around the air suction opening and between the adjacent recesses.

9 Claims, 14 Drawing Sheets

(51) Int. Cl.
*F04D 25/06* (2006.01)
*F04D 29/28* (2006.01)

(56) References Cited

U.S. PATENT DOCUMENTS

| | | | | |
|---|---|---|---|---|
| 6,739,835 | B2 | 5/2004 | Kim | |
| 7,163,371 | B2 | 1/2007 | Higashida | |
| 7,470,107 | B2 | 12/2008 | Chen | |
| 9,011,092 | B2 | 4/2015 | Eguchi et al. | |
| 2002/0106277 | A1 | 8/2002 | Chapman | |
| 2004/0033135 | A1 | 2/2004 | Chang | |
| 2006/0051205 | A1 | 3/2006 | Platz | |
| 2006/0251513 | A1 | 11/2006 | Kalavsky et al. | |
| 2008/0069689 | A1 | 3/2008 | Sun et al. | |
| 2010/0098544 | A1 | 4/2010 | Keber et al. | |
| 2010/0209270 | A1 | 8/2010 | Yen et al. | |
| 2010/0329857 | A1* | 12/2010 | Heli | F04D 25/0613 415/182.1 |

FOREIGN PATENT DOCUMENTS

| | | | |
|---|---|---|---|
| JP | 2003-074495 | A | 3/2003 |
| JP | 2004-190535 | A | 7/2004 |
| JP | 2004-360670 | A | 12/2004 |
| JP | 2005-241018 | A | 9/2005 |
| JP | 2006-207595 | A | 8/2006 |
| JP | 2010127165 | A | 6/2010 |

* cited by examiner

SECTION ALONG LINE B-B

SECTION ALONG LINE C-C

RELATED ART

CENTRIFUGAL FAN

CROSS-REFERENCES TO RELATED APPLICATIONS

This application is a continuation of U.S. patent application Ser. No. 13/517,655 filed on Jun. 14, 2012, which claims priority to Japanese Patent Application No. 2011-162326 filed Jul. 25, 2011. The entire disclosures of these applications are incorporated herein by reference.

BACKGROUND OF THE INVENTION

1. Field of the Invention

The present invention relates to a centrifugal fan, and more particularly, to a centrifugal fan having a casing and an impeller.

2. Description of the Related Art

A centrifugal fan (centrifugal blower) is a fan for blowing air in a radial direction by rotating an impeller including a plurality of blades (also referred to as wings, impeller). One of this kind of fans is a centrifugal multi-blade fan which includes a casing having a suction opening and a discharge opening and accommodating therein an impeller having a plurality of blades around a rotary shaft of a motor. The centrifugal multi-blade fan suctions air from the suction opening, allows the air flow through the blades from the center of the impeller, and discharges the air outward in the radial direction of the impeller by a centrifugal action from the rotation of the impeller. The air discharged from the outside of the outer circumference of the impeller passes through the casing while increasing the pressure of the air, and the high-pressure air is discharged from the discharge opening.

These centrifugal multi-blade fans are widely used for cooling, ventilation, and air-conditioning in home appliances, office equipment, and industrial equipment, and in blowers for vehicles and the like. The blowing performance and noise of such centrifugal multi-blade fan are largely affected by a blade shape of an impeller and a shape of a casing.

The following patent application publications disclose improvement in blade shapes of fans, for example.

JP-A-2006-207595 discloses a technique for suppressing air from flowing back from a gap formed by an upper case having a bell mouth and a shroud in a centrifugal blower. In other words, the centrifugal blower has the bell mouth formed in the vicinity of an air suction opening of the upper case which accommodates a fan, and the bell mouse has a substantially semi-circular arc in a cross section such that the gap between the upper case and an upper end portion of the shroud narrows.

JP-A-H9-242696 discloses a centrifugal blower for reducing noise of the entire centrifugal blower while suppressing a separation phenomenon between blades and air flowing through blades. That is, the centrifugal blower has a bell mouth ring which is formed in the vicinity of an outer side of a shroud in a radial direction and has a deflection wall surface. The deflection wall surface is configured to deflect air which is discharged outward in the radial direction from a centrifugal multi-blade fan and flowing inwardly toward a rotary shaft, toward the motor side such that the air flows along an inner wall of a casing on the suction opening side. In this manner, it is possible to suppress air from flowing back from a gap between a shroud and the casing to the suction opening. Therefore, it is possible to reduce noise generated due to the interference between air suctioned from the suction opening and the back-flow air, and disturbance of a flow generated when the air flows back in the gap.

JP-A-2004-360670 discloses a centrifugal multi-blade blower capable of preventing disturbance of a flow in the vicinity of a suction opening. That is, the multi-blade blower is a blower for suctioning an air from a direction of a rotation axis, and discharging the fluid in a direction intersecting with the rotation axis, and includes an impeller and a bell mouth. The impeller rotates around the rotation axis. The bell mouth has a suction opening formed to face the impeller, and a recess which is recessed toward the impeller to form a negative-pressure space around the suction opening, and guides a suctioned air to the impeller.

JP-A-2004-190535 discloses a centrifugal blower which suppresses an air flow from being disturbed at a bell mouth portion. That is, the centrifugal blower has an outer wall surface of a scroll casing in which a suction-side outer wall surface connected to the bell mouth portion is formed in a flat shape with no difference in level. In this way, it is possible to suppress disturbance such as a vortex from occurring in suctioned air from flowing toward a suction opening. Therefore, it is possible to suppress an air flow from being disturbed at the bell mouth portion, and thus it is possible to prevent a new vortex loss, noise, and the like from being induced.

As apparatuses have been reduced in sizes and thicknesses, have increased in assembly densities, and have been reduced in power consumption, it has been strongly required from the market to improve static pressures and efficiency for fan motors for those apparatuses. As for fans, it is also important to reduce noise. Particularly, related-art centrifugal fans tend to cause high discrete frequency noise (narrowband noise) and high wideband noise, so that large noise is caused when the centrifugal fans are installed in apparatuses.

Here, the discrete frequency noise is noise based on a blade passing frequency, and is also called as NZ noise. The discrete frequency noise is noise having a characteristic peak at a specific frequency of a narrow frequency band. This frequency can be expressed by the equation: fnz=n (rotational frequency)×z (number of blades). Since not only the primary component but also the secondary and higher components occur, the discrete frequency noise becomes a big problem even in actual hearing. In other words, when those centrifugal fans are installed in apparatuses, there is a risk that noise might occur as clear sound. Also, since a turbulent flow is a dominant factor of wideband noise, and determines a total noise level, it is also required to reduce the wideband noise.

Further, in addition to implementation of the above requirements, it is also required to improve the productivity of fans.

Those techniques disclosed in the above publications are designed for a scroll casing-type fan, and it is also desired to improve a fan having an open-type casing.

SUMMARY OF THE INVENTION

The present invention has been made in view of the above circumstances, and it is an object of the present invention to provide a centrifugal fan which can improve an air flow.

According to an illustrative embodiment of the present invention, there is provided a centrifugal fan comprising: an upper casing which has an air suction opening; a lower casing; and an impeller which is disposed between the upper casing and the lower casing. The impeller includes an upper shroud which is provided on an upper casing side, and a plurality of blades which are arranged along a circumference direction below the upper shroud, and is rotatable around a rotary shaft. The upper casing and the lower casing configure an open-type casing. A surface of the upper shroud facing the upper casing includes a first portion which becomes closer to the lower casing as separating further from the rotary shaft. A surface of the upper casing facing the upper shroud includes a second portion which faces the first portion of the upper shroud and becomes closer to the lower casing as separating further from the rotary shaft.

In the above centrifugal fan, the impeller may further include a lower shroud which is provided below the plurality of blades, an outside diameter of the lower shroud may be equal to or smaller than an inside diameter of the upper shroud, and an inside portion of each of the blades may have an inclined portion which connects an inside circle portion of the upper shroud and an inside circle portion of the lower shroud.

In the above centrifugal fan, a shape of the first portion of the upper shroud may be almost same as a shape of the second portion of the upper casing.

In the above centrifugal fan, the upper casing may include ribs for configuring the second portion which faces the first portion of the upper shroud.

In the above centrifugal fan, the upper casing may include a flange portion for attachment of the centrifugal fan.

In the above centrifugal fan, in a range where the upper shroud and the blades exist in a planar view, the upper shroud may be in contact with the blades.

In the above centrifugal fan, each of the plurality of blades may have a shape which becomes thinner as separating further from the rotary shaft.

In the above centrifugal fan, the lower casing may have a protrusion which protrudes toward the impeller in a portion where the upper shroud exists in a planar view, and air suctioned from the suction opening may be discharged outward in a radial direction of the impeller by centrifugal force from the rotation of the impeller.

According to the above configuration, a centrifugal fan which can improve an air flow can be provided.

DETAILED DESCRIPTION

Hereinafter, illustrative embodiments of the present invention will be described with reference to the accompanying drawings.

Figure 1:
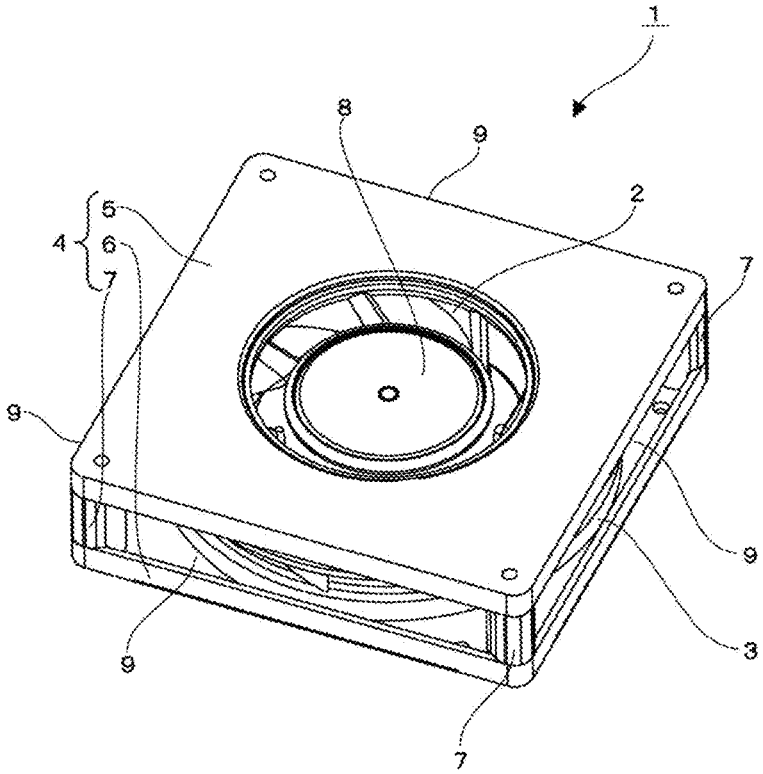
FIG. 1 is a perspective view illustrating a centrifugal fan according to an embodiment of the present invention.
Figure 2:
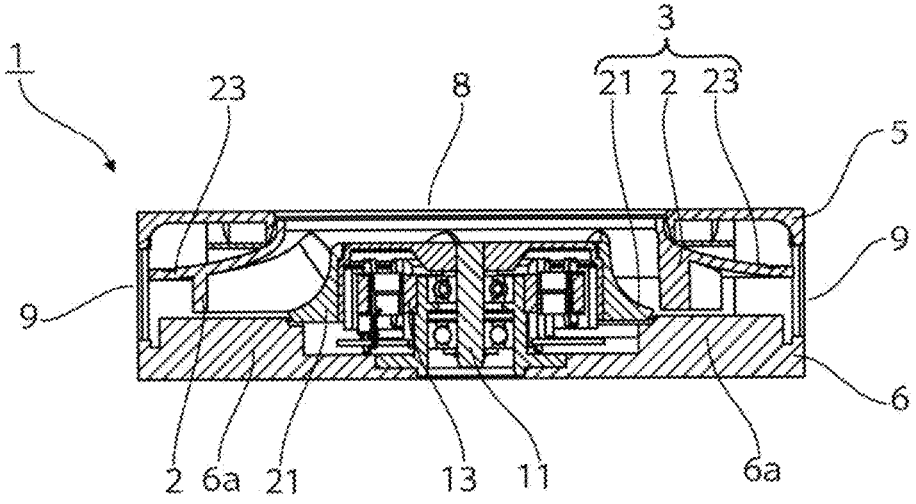
FIG. 2 is a view illustrating the longitudinal section of the middle of the centrifugal fan of FIG. 1.
Figure 3:
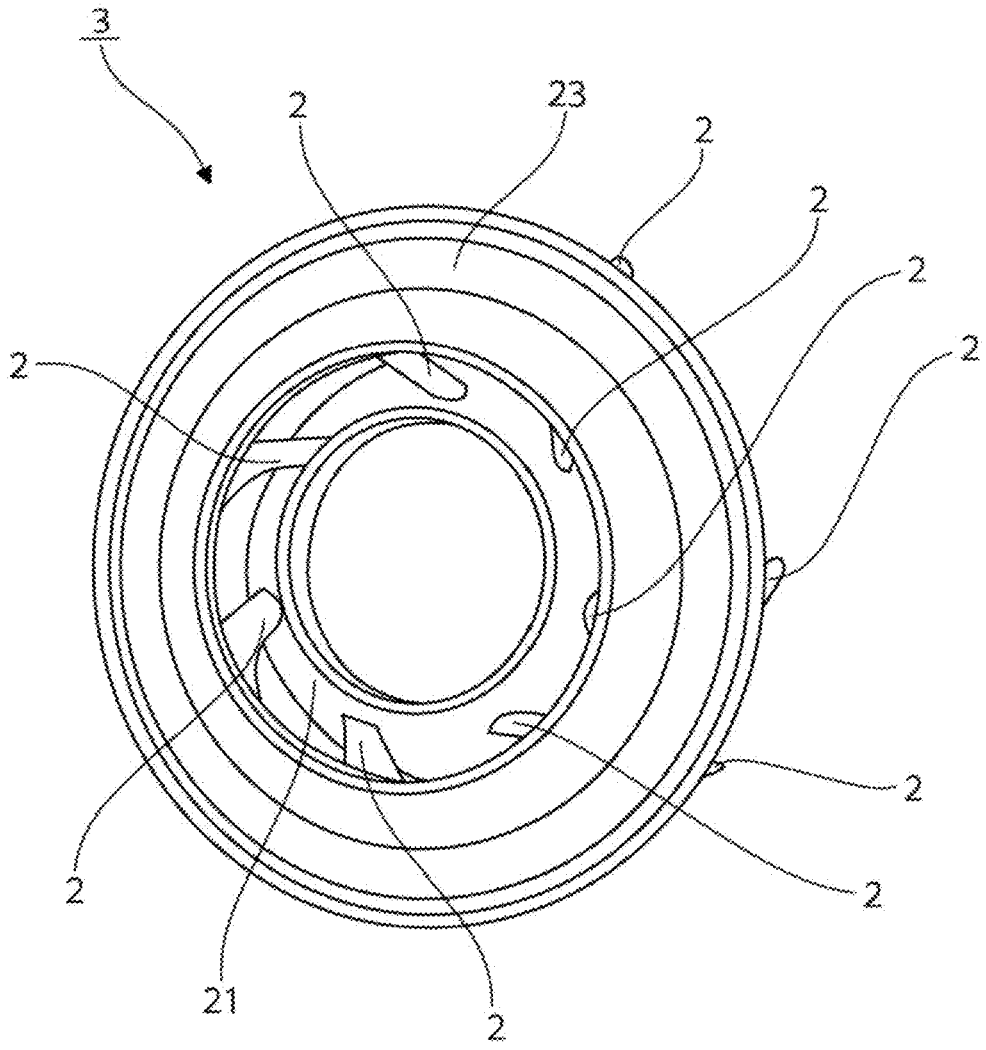
FIG. 3 is a perspective view illustrating an impeller 3 as seen from a side of an upper shroud 23.
Figure 4:
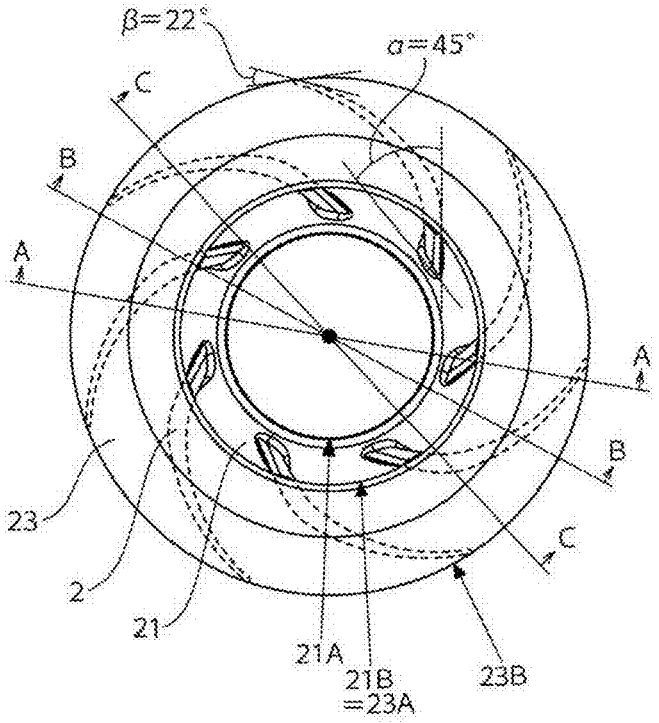
FIG. 4 is a view illustrating a blade shape of the centrifugal fan of FIG. 1 as seen from a side of the upper shroud 23.
Figure 5:
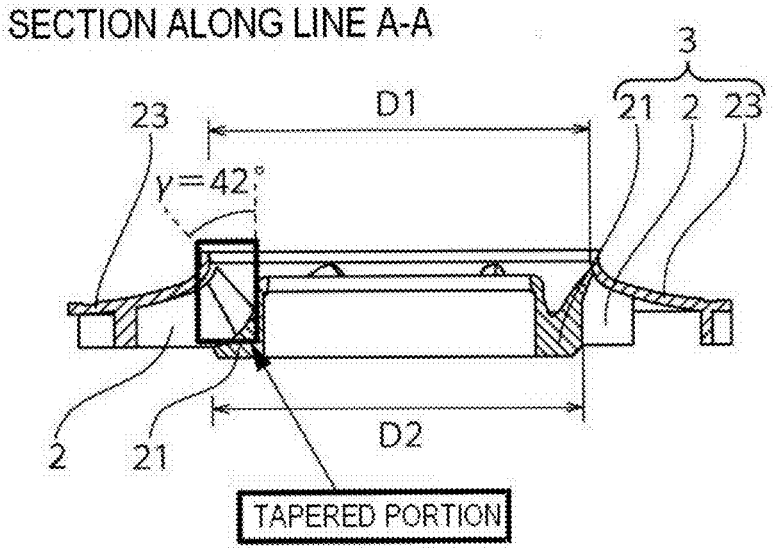
FIG. 5 is a cross-sectional view taken along line A-A of FIG. 4.
Figure 6:
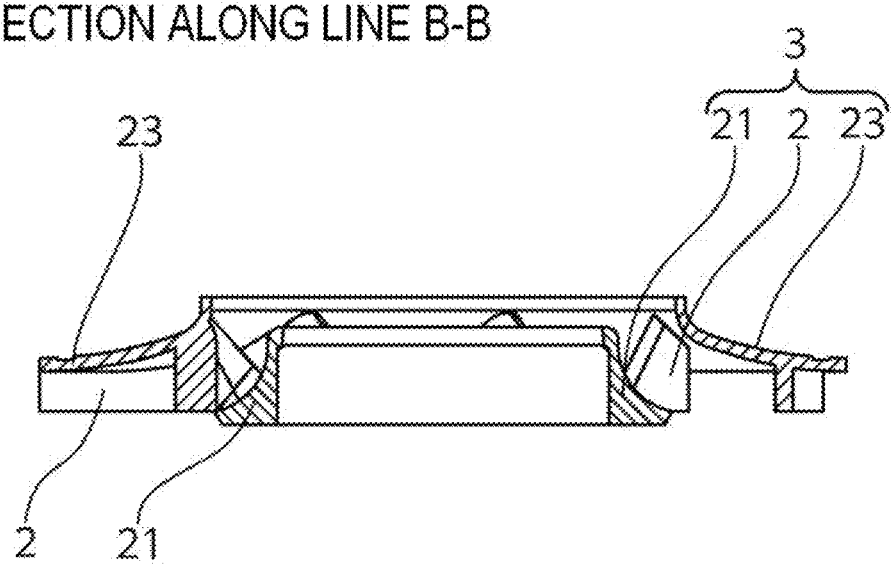
FIG. 6 is a cross-sectional view taken along line B-B of FIG. 4.
Figure 7:
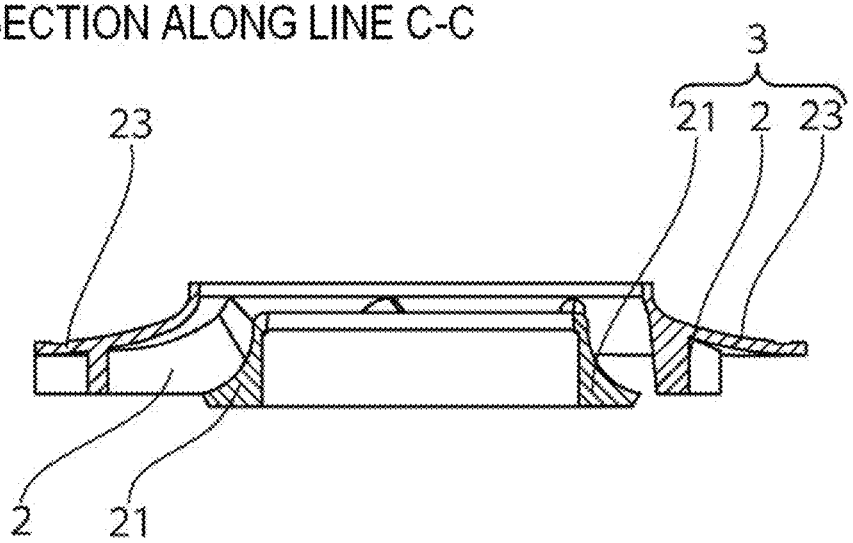
FIG. 7 is a cross-sectional view taken along line C-C of FIG. 4.

FIG. 1 is a perspective view illustrating a centrifugal fan according to an illustrative embodiment of the present invention, and FIG. 2 is a view illustrating a longitudinal section at a middle part of the centrifugal fan of FIG. 1. FIG. 3 is a perspective view illustrating an impeller 3 as seen from a side of an upper shroud 23, and FIG. 4 is a view illustrating a blade shape of the centrifugal fan of FIG. 1 as seen from the side of the upper shroud 23. FIGS. 5 to 7 are cross-sectional views taken along lines A-A, B-B, and C-C of FIG. 4, respectively.

Referring to FIGS. 1 to 4, in a centrifugal fan 1, a central impeller 3 rotates to blow air. The impeller 3 includes seven blades 2 disposed at regular intervals, and rotates around a rotary shaft 11 by a fan motor 13 provided in the centrifugal fan 1. The direction of the rotation is a clockwise direction in FIG. 4.

The impeller 3 is accommodated in a casing 4. The casing 4 is configured by an upper casing 5 and a lower casing 6 which have plate shape, and in order to place the upper casing 5 and the lower casing 6 evenly spaced apart from each other, four columnar supports 7 are provided at four corners of the casing 4, respectively. At the top of the centrifugal fan 1, an air suction opening 8 is formed. Air discharge openings 9 are provided between the respective columnar supports 7 of the casing 4. In other words, the air discharge openings 9 are provided at four sides of the casing 4 in four directions (open casing type). The casing 4 may have one discharge opening for collecting air discharged from the impeller 3 in one direction (scroll casing type).

As shown in FIGS. 2 to 7, the impeller 3 has an annular lower shroud 21, an annular upper shroud 23, and a plurality of blades 2 which are arranged along a circumference direction between the lower shroud 21 and the upper shroud 23, and is rotatable around the rotary shaft 11.

As shown in FIG. 4, the annular lower shroud 21 has an inside circle 21A and an outside circle 21B in a planar view. The inside circle 21A and the outside circle 21B are circles in a planar view. The annular upper shroud 23 has an inside circle 23A and an outside circle 23B in a planar view. The inside circle 23A and the outside circle 23B are circles in a planar view. The outside circle 21B of the lower shroud 21 overlaps the inside circle 23A of the upper shroud 23. In other words, the outside circle 21B of the lower shroud 21 is the same as the inside circle 23A of the upper shroud 23. However, the outside circle 21B of the lower shroud 21 may be slightly smaller than the inside circle 23A of the upper shroud 23.

In FIG. 4, the shape of each blade 2 seen from the internal space of the inside circle 23A of the upper shroud 23 is shown by a solid line. Further, the shape of each blade 2 hidden between the inside circle 23A and outside circle 23B of the upper shroud 23 by the upper shroud 23 is shown by a dotted line.

As shown in FIG. 4, each blade 2 has a shape tapering from the inside (rotary shaft) to the outside in a planar view. In other words, each blade 2 has a shape becoming thinner as separating further from the rotary shaft 11. Each blade 2 has an inlet angle of 45° and an outlet angle 22°. The diameter of the outside circle 23B is 120 mm, and the diameter of the inside circle 21A is 70 mm. The blades 2 are backward inclined blades.

As shown in FIGS. 3 to 7, the upper portion of each blade 2 is fixed to the lower surface of the upper shroud 23, and the lower portion of each blade 2 is fixed to the upper surface of the lower shroud 21. Here, since the outside circle 21B of the lower shroud 21 is designed to be the same as the inside circle 23A of the upper surface (or the outside circle 21B of the lower shroud 21 is smaller than the inside circle 23A of the upper surface), it is possible to integrally form the impeller 3 only by using upper and lower molds.

As shown in FIGS. 4 to 7, the inside circle side (the side close to the rotary shaft) of the upper portion of each blade 2 is connected to the inside-circle-side end portion of the upper shroud 23. From this position to the outside-diameter-side end portion of the upper portion of each blade 2, the upper portion of each blade 2 is connected to the lower surface of the upper shroud 23. In other words, as shown in FIG. 4, in a range where the upper shroud 23 and the blades 2 exist (a place surrounded by a dotted line) in a planar view, the upper shroud 23 is in contact with the blades 2.

Further, the lower portion of each blade 2 is connected to the lower shroud 21.

As shown in FIG. 5, the inside circle side of the upper portion of each blade 2 is connected to the inside-circle-side end portion of the upper shroud 23. The upper portion of each blade 2 has a tapered portion (inclined portion) from that position toward the inside circle side. In other words, the inside circle portion of each blade 2 has an inclined portion which connects the inside circle portion (inside-circle end portion) of the upper shroud 23 and the inside circle portion of the lower shroud 21.

The tapered portion of each blade 2 forms an inclined surface having an angle γ of 42° with respect to a vertical direction. In FIG. 4, a portion of each blade 2 shown by a solid line is a tapered portion, and a portion of each blade 2 shown by a dotted line shows a portion in which the upper portion of the corresponding blade 2 is connected with the upper shroud 23. Further, the portion of each blade 2 shown by the solid line shows a portion in which the lower portion of the corresponding blade 2 is connected with the lower shroud 21. The portion of each blade 2 shown by the dotted line shows a portion in which the lower portion of the corresponding blade 2 is not connected with the lower shroud 21 (a portion below which the lower shroud 21 does not exist).

The angle γ, which is 42° in FIG. 5, is called a taper angle, and the angle γ is not limited to 42°.

In the impeller 3, in a portion in which the upper shroud 23 exists in a planar view, the lower shroud 21 does not exist. Therefore, it is preferable to provide a protrusion 6*a* at the upper portion of the lower casing 6 as shown in FIG. 2 such that the protrusion 6*a* protrude upward and takes place of the lower shroud 21 at the portion of the impeller 3 in which the lower shroud 21 does not exist. The protrusion 6*a* is formed at the portion where the upper shroud 23 exists (the portion where the lower shroud 21 does not exist) in a planar view such that a distance between the lower portion of each blade 2 and the lower casing 6 becomes shorter. The protrusion 6*a* protrudes to a height at which the lower shroud 21 exists. In this way, it is possible to allow the lower casing 6 to have a structure for acting as the lower shroud.

In the above-mentioned impeller 3, the inside circle portion of each blade 2 has a tapered shape. The base portion of the tapered portion is integrated with the lower shroud 21. The upper portion of each blade 2 is entirely integrated with the upper shroud 23 except for the tapered portion. Further, as shown in FIG. 5, the inside diameter D1 of the upper shroud 23 is the almost the same as the outside diameter D2 of the lower shroud 21 (D1≈D2) or may be larger than the outside diameter D2 of the lower shroud 21 (D1≥D2). This shape makes it possible to integrally form the impeller 3 only by upper and lower molds and provide the high-productivity impeller 3 and the high-productivity centrifugal fan 1.

Further, since it is unnecessary to increase or decrease the diameter of the air suction opening, it is possible to suppress a static pressure and an air flow from being reduced.

Furthermore, in the centrifugal fan 1 according to this illustrative embodiment, it is possible to improve an air flow by the tapered shape of each blade 2. Moreover, it is possible to cover the suction opening portion with the shrouds. Therefore, it is possible to reduce noise. This feature will be described below.

Figure 8A:
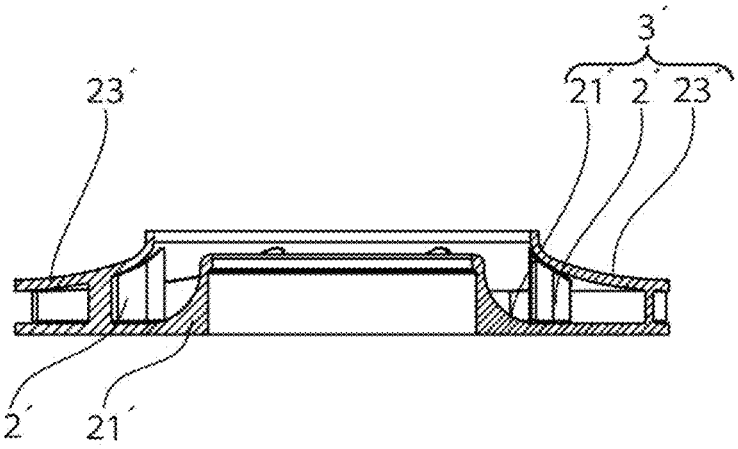
FIGS. 8A and 8B are views illustrating a cross-sectional shape and noise characteristic of a related-art impeller, respectively.
Figure 8B:
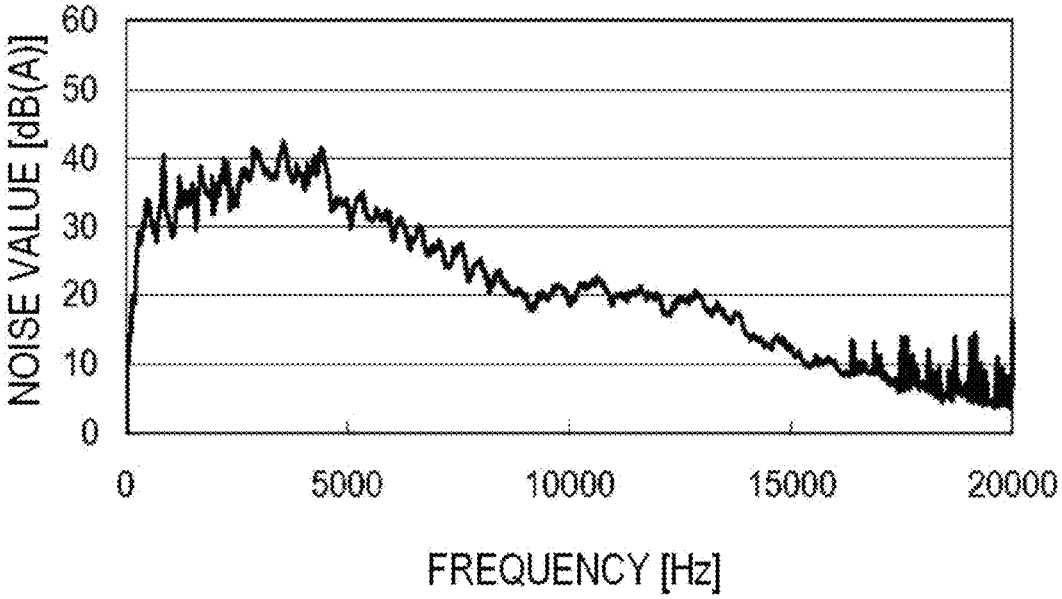
RELATED ART FIG.8B

FIGS. 8A and 8B are views illustrating a cross-sectional shape and noise characteristic of a related-art impeller, respectively.

As shown in the cross-sectional view of FIG. 8A, a related-art impeller 3' includes a lower shroud 21', an upper shroud 23', and a plurality of blades 2' disposed between the lower shroud 21' and the upper shroud 23'. The outside circle of the lower shroud 21' is the same as the outside circle of the upper shroud 23'. Therefore, it is not possible to integrally form the impeller 3' only by upper and lower molds.

FIG. 8B shows a noise characteristic during driving of the impeller 3' of FIG. 8A by taking frequencies on a horizontal axis and noise values (dB(A)) on a vertical axis.

Noise is 58.0 dB(A) in total, and both of discrete frequency noise and wideband noise (turbulence noise) shows high values as shown in FIG. 8B.

Figure 9A:
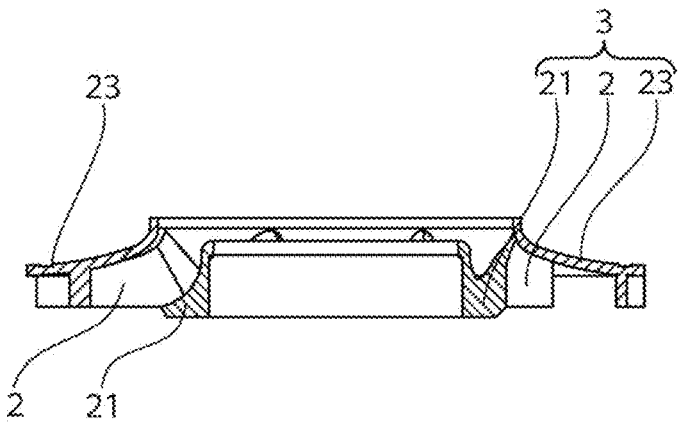
FIGS. 9A and 9B are views illustrating a cross-sectional shape and noise characteristic of the impeller according to an illustrative embodiment of the present invention, respectively.
Figure 9B:
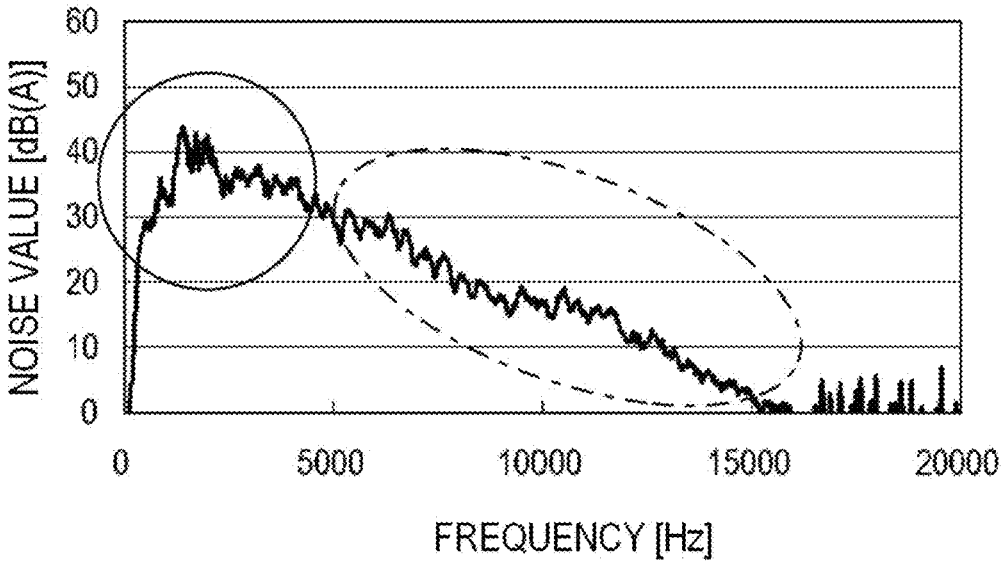

FIGS. 9A and 9B are views illustrating a cross-sectional shape and noise characteristic of the impeller according to the illustrative embodiment of the present invention, respectively.

As shown in the cross-sectional view of FIG. 9A, the impeller 3 according to the present illustrative embodiment includes the lower shroud 21, the upper shroud 23, and the plurality of blades 2 disposed between the lower shroud 21 and the upper shroud 23. The outside circle of the lower shroud 21 is almost the same as the inside circle of the upper shroud 23. Therefore, it is possible to integrally form the impeller only by upper and lower molds.

FIG. 9B shows a noise characteristic during driving of the impeller of FIG. 9A by taking frequencies on a horizontal axis and noise values (dB(A)) on a vertical axis.

Noise is 57.3 dB(A) in total. Further, as shown in a solid line circle of FIG. 9B, discrete frequency noise (the primary and secondary noise of the blades) is lower than that in FIG. 8B. Furthermore, as shown in a dotted line circuit of FIG. 9B, wideband noise (turbulence noise) is also lower than that in FIG. 8B.

Figure 10:
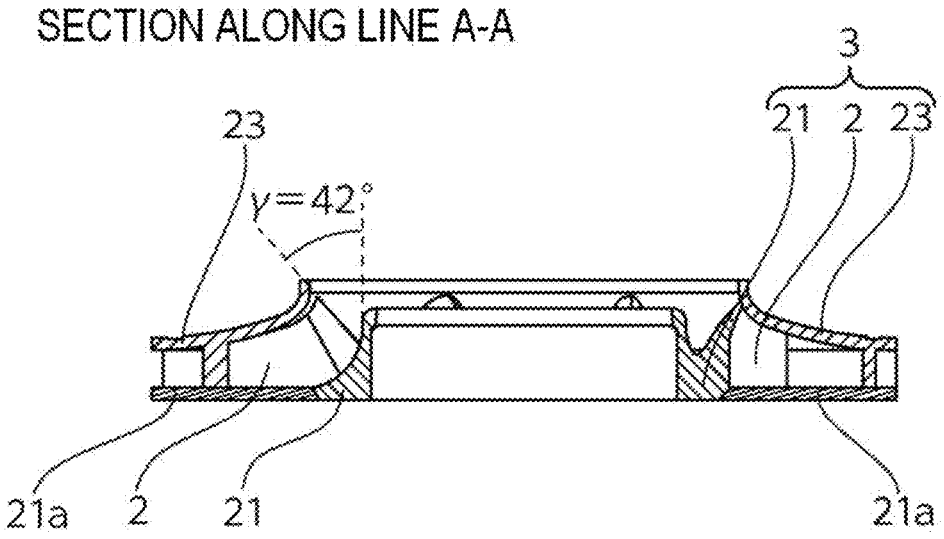
FIG. 10 is a cross-sectional view illustrating an impeller of a centrifugal fan according to a modified illustrative embodiment.

FIG. 10 is a cross-sectional view illustrating an impeller of a centrifugal fan according to a modified illustrative embodiment.

An impeller 3 according to the modified illustrative embodiment is different from the impeller shown in FIGS. 1 to 7 in that a base plate (plate) 21*a* for extending the outside circle of the lower shroud 21 outward is attached at the lower portion of the impeller 3. The diameter (inside diameter) of a hollow portion of the base plate 21*a* is the same as the outside diameter of the lower shroud 21. The outside diameter of the base plate 21*a* is the same as the outside diameter of the upper shroud 23. Therefore, it is possible to make the outside circle of the upper shroud 23 coincide with the outside circle of the base plate 21*a*, and to secure the same P-Q characteristic as that of the configuration of the impeller 3 as shown in FIG. 8A. In other words, the base plate 21*a* functions as an appendant lower shroud. Since the base plate 21*a* is attached, it is also possible to reduce noise while maintaining the P-Q characteristic.

Even in this modified illustrative embodiment, the portion of the impeller 3 except for the base plate 21*a* can be integrally formed only by upper and lower molds, such that the productivity of the impeller is improved.

[Other(s)]

The fan according to the illustrative embodiment is adaptable to all centrifugal fans such as a turbo type, a multi-blade type, and a radial type. The fan can be mainly installed in products requiring suction and cooling (such as home appliances, PCs, OA equipment, and in-vehicle equipment) and the like.

Effect(s) of Illustrative Embodiment

As described above, the impeller according to the illustrative embodiment, the upper shroud does not overlap the lower shroud at all in a planar view. Therefore, it is possible to manufacturing the impeller by integral molding using upper and lower molds, and thus the productivity of the impeller is high.

The upper portion of the inside circle portion of each blade contacts the top of the upper shroud. The inside circle portion of each blade lowers from that position to a lower portion with an inclination (the taper angle $\gamma$), so that the lower portion of the inside circle portion of the corresponding blade comes into contact with the lower shroud. Therefore, the diameter of the suction opening does not increase, and thus the highest static pressure is not reduced.

Further, according to the illustrative embodiment, it is possible to make an efficient blade shape in view of an air flow such that a flow increases, the static pressure increases, and noise is reduced.

Another Illustrative Embodiment

Figure 11:
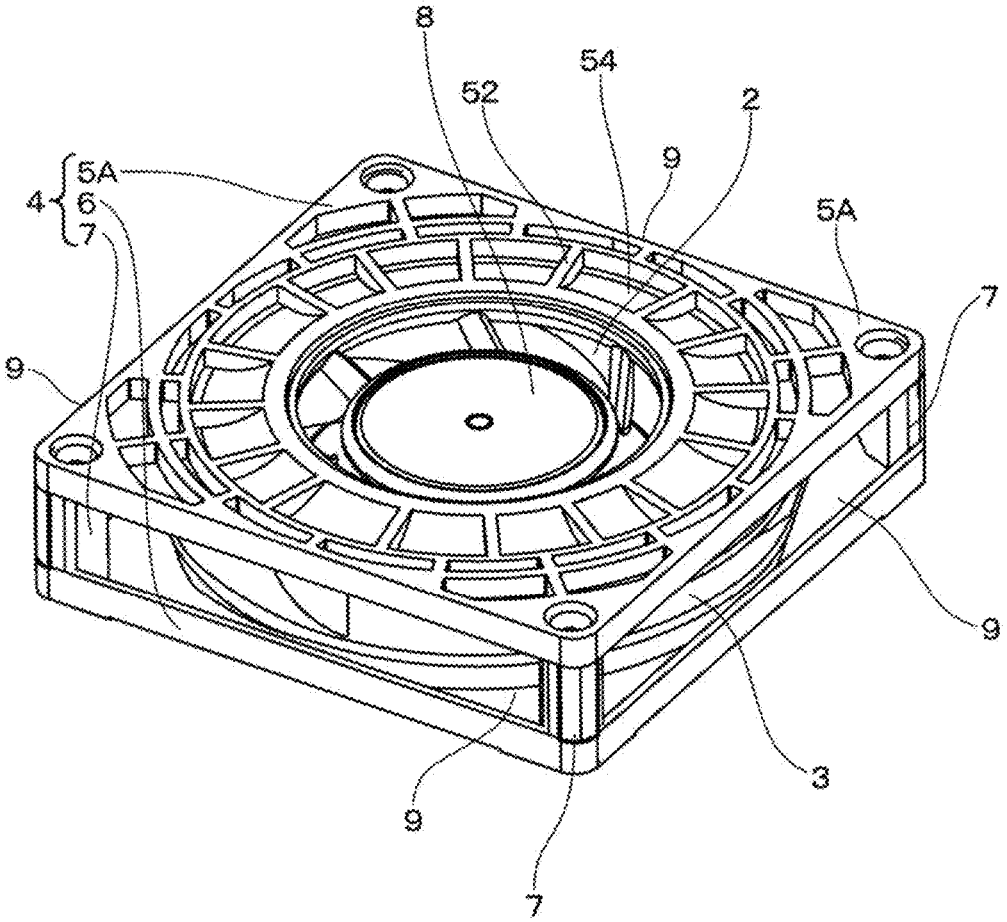
FIG. 11 is a perspective view illustrating a centrifugal fan according to another illustrative embodiment.
Figure 12:
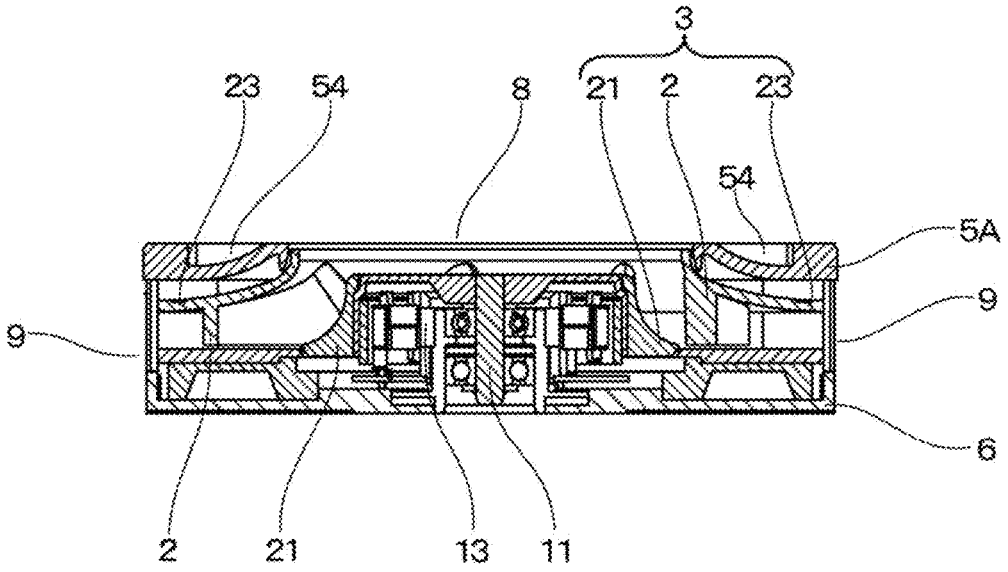
FIG. 12 is a view illustrating the longitudinal section of the middle of the centrifugal fan of FIG. 11.

FIG. 11 is a perspective view illustrating a centrifugal fan according to another illustrative embodiment, and FIG. 12 is a view illustrating the longitudinal section of the middle of the centrifugal fan of FIG. 11.

The centrifugal fan of FIG. 11 is different from the centrifugal fan of FIG. 1 in a structure of an upper casing 5A. That is, the upper casing 5A has an upper surface formed with a plurality of recesses 54, and ribs 52 between the adjacent recesses 54.

Figure 16:
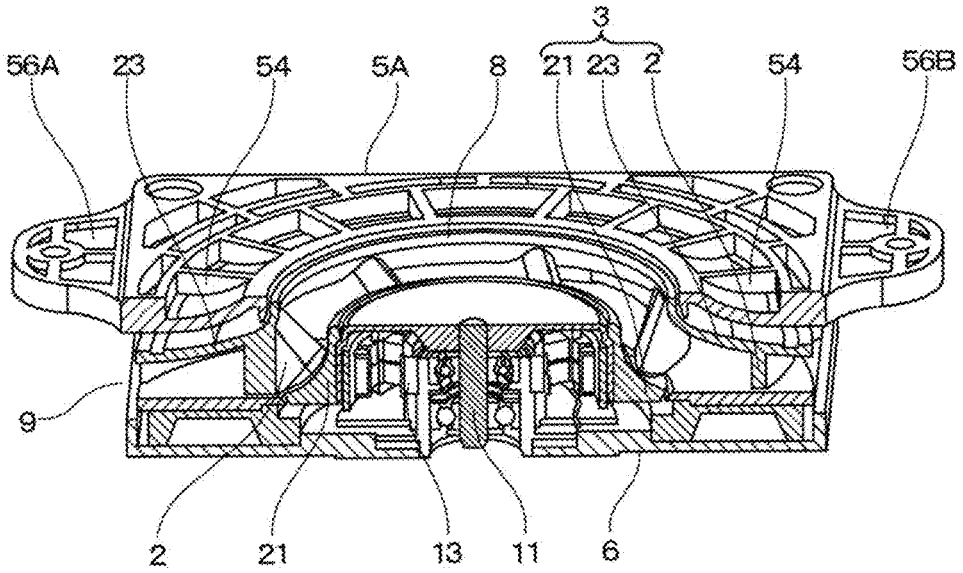
FIG. 16 is a view illustrating a cross section structure of a centrifugal fan according to a modified illustrative embodiment.

The plurality of recesses 54 are formed to surround the rotary shaft 11. The ribs 52 are formed radially around the rotary shaft 11. The number of the recesses 54 is 16 as shown in FIG. 16. The number of ribs 52 is also 16. The number of recesses 54 or ribs 52 is not limited thereto.

As shown in FIG. 12, the upper surface of the upper shroud 23 (the surface facing the upper casing 5A) has a portion (first portion) which becomes closer to the lower casing 6 as separating further from the rotary shaft 11. In this portion, the upper surface of the upper shroud 23 has a curved surface.

Each recess 54 is shallow at a portion close to the rotary shaft 11 and is deep at a portion away from the rotary shaft 11, such that the bottom surface of the recess 54 connecting the two portions becomes a curved surface. The thickness of a portion between the bottom surface of each recess 54 and the lower surface of the upper casing 5A (the surface facing the upper shroud 23) on a side of the upper casing 5A opposite to the bottom surface of the recess 54 is kept constant. In this portion where the thickness is kept constant, the lower surface portion (second portion) of the upper casing 5A has a curved surface which has almost same shape as (or is the same as) that of the bottom surface of the recess 54. In other words, the curved surface of the first portion is almost same as (or is same as) the curved surface of the second portion.

According to this configuration, the centrifugal fan according to the illustrative embodiment has the following features.

(1) The lower surface of a case (the upper casing 5A) having the air suction opening 8 has a shape having a curvature which is close to (or the same as) that of the upper surface of the upper shroud 23. Therefore, air coming from a discharge opening side of the impeller 3 can be suppressed from flowing back toward the suction opening 8 in a space between the upper casing 5A and the upper shroud 23. Therefore, deterioration of the characteristic of the fan can be prevented.

(2) If the lower surface of the upper casing 5A is formed simply in the shape described in (1), the upper casing 5A becomes thick. However, since the recesses 54 are provided, it is possible to prevent the upper casing 5A from becoming thick (it is possible to reduce the use of a material). Instead of the recesses 54, one recess having a doughnut shape with the center at the rotary shaft 11 may be formed. In this case, if the ribs 52 are provided at predetermined angular intervals, it is possible to give a constant rigidity to the upper casing 5A.

(3) As the impeller 3, any one of the impellers of FIGS. 1 to 10 may be used (even a related-art impeller may be used). Further, the shape of the blades 2 is arbitrary.

Figure 13:
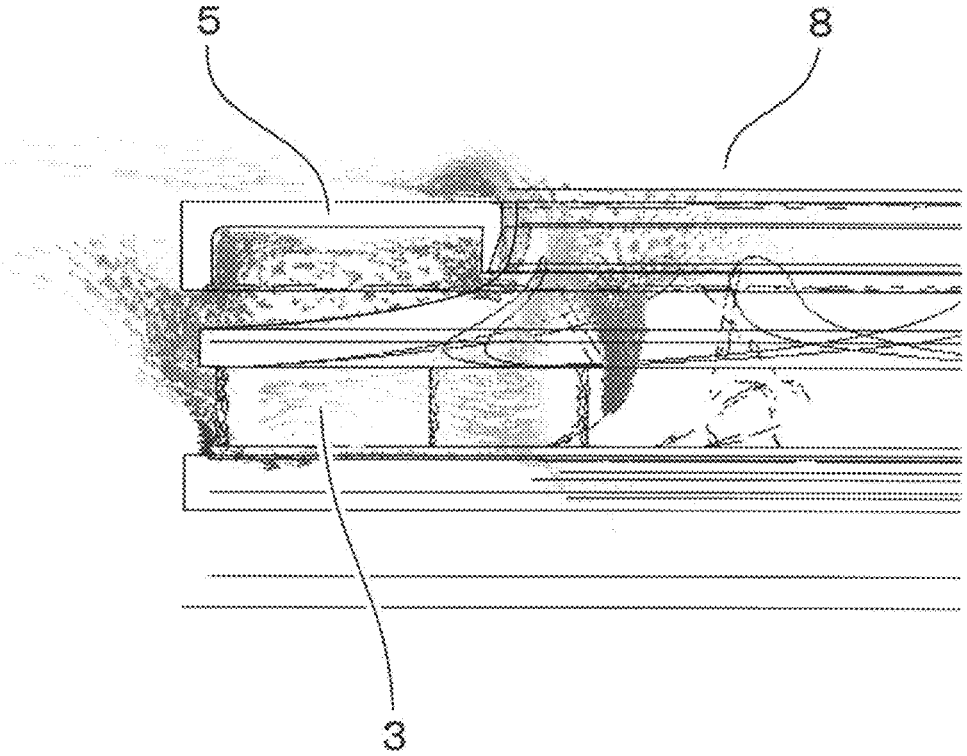
FIG. 13 is a view illustrating an air flow between an upper shroud and an upper casing of the centrifugal fan shown in the section of FIG. 2.
Figure 14:
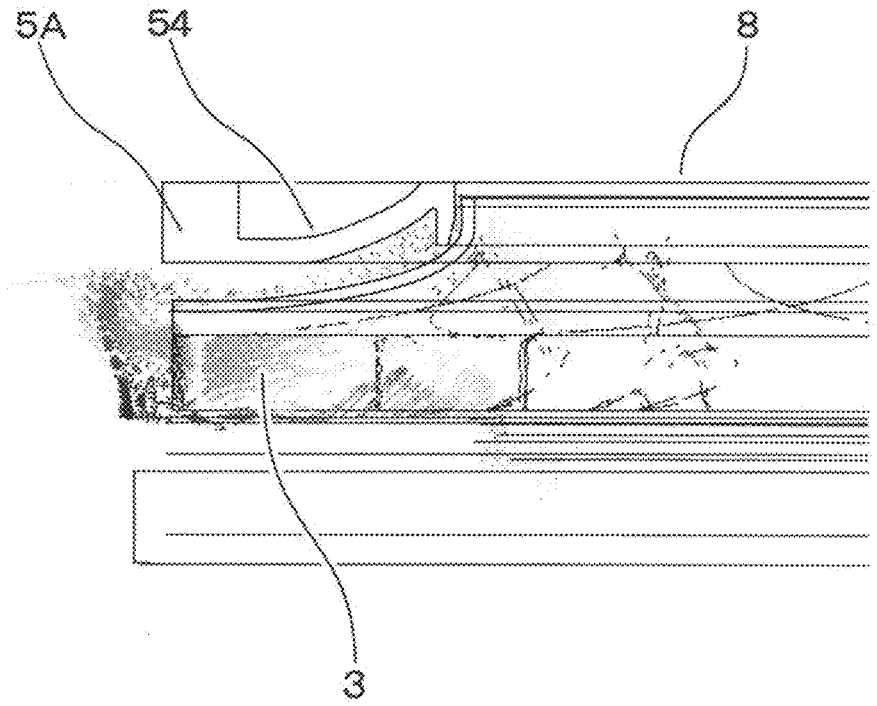
FIG. 14 is a view illustrating an air flow between an upper shroud and an upper casing of the centrifugal fan shown in the section view of FIG. 12.

FIG. 13 is a view illustrating an air flow between an upper shroud and an upper casing of the centrifugal fan shown in the section of FIG. 2, and FIG. 14 is a view illustrating an air flow between an upper shroud and an upper casing of the centrifugal fan shown in the section of FIG. 12.

As shown in FIG. 13, in a case where the surface of the upper casing 5 facing the impeller 3 is flat, a small room is formed between the impeller 3 and the upper casing 5, and a portion of air discharged from the impeller 3 flows back in the small room toward the air suction opening 8. Further, a portion of the back-flow air swirls inside the small room.

In contrast, as shown in FIG. 14, if the recesses 54 are provided to the upper casing 5A such that the surface of the upper casing 5A facing the impeller 3 has a shape with the same curvature as that of the upper shroud of the impeller 3, it is possible to suppress (improve) a back flow of air.

Figure 15:
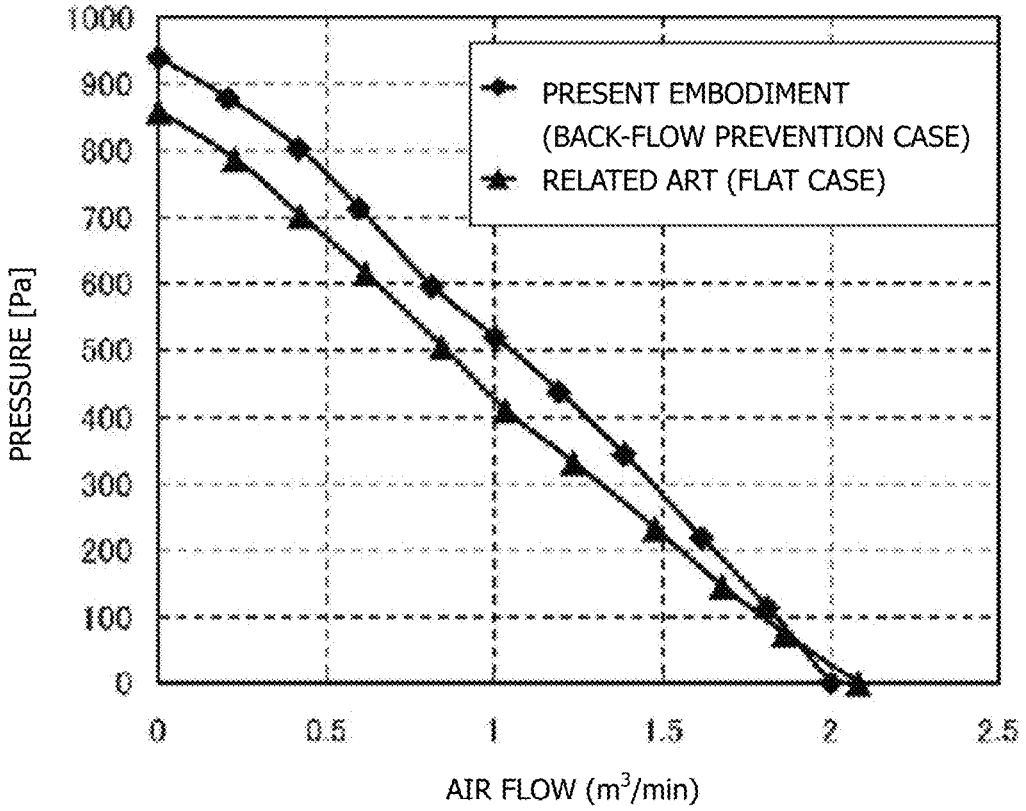
FIG. 15 is a view illustrating the air flow-pressure characteristics of the centrifugal fan shown in the section of FIG. 2 and the centrifugal fan shown in the section of FIG. 12.

FIG. 15 is a view illustrating the air flow-pressure characteristics of the centrifugal fan shown in the section of FIG. 2 and the centrifugal fan shown in the section of FIG. 12.

In FIG. 15, the characteristic of the centrifugal fan shown in the section of FIG. 12 is shown by a mark of 'PRESENT EMBODIMENT (BACK-FLOW PREVENTION CASE)', and the characteristic of the centrifugal fan shown in the section of FIG. 2 is shown by a mark of 'RELATED ART (FLAT CASE)'. That is, the structure of the upper casing 5 having the flat lower portion shown in FIG. 2 is called as a flat case, and the structure of the upper casing 5A shown in FIG. 12 is called as a back-flow prevention case.

As shown in FIG. 15, if the structure for preventing a back flow of air is used, it is possible to improve the characteristic of the fan.

Figure 17:
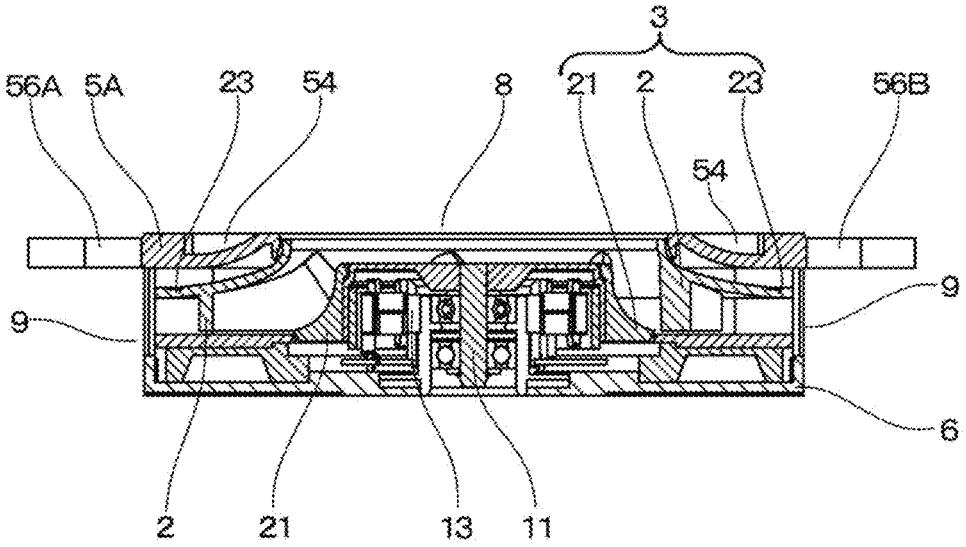
FIG. 17 is a cross-sectional view illustrating the centrifugal fan according to the illustrative modified embodiment.

FIG. 16 is a view illustrating a cross section structure of a centrifugal fan according to a modified illustrative embodiment, and FIG. 17 is a cross-sectional view illustrating the centrifugal fan according to the modified illustrative embodiment.

The centrifugal fan according this modified illustrative embodiment is configured by forming flanges 56A and 56B for attachment of the centrifugal fan, integrally with the upper casing 5A of the fan shown in FIGS. 11 and 12. The flanges 56A and 56B are formed with screw holes. Therefore, it is possible to easily attach the fan to another component by inserting screws into the screw holes. One or more flanges may be provided, and it is possible to facilitate attachment of the fan.

The above-mentioned illustrative embodiments should be considered as illustrative in all aspects, but not restricting. The scope of the present invention is defined by the appended claims rather than the foregoing description, and is intended to include all modifications in the equivalent meaning and range to the scope of the claims.

What is claimed is:

1. A centrifugal fan comprising:

a casing comprising:

an upper casing which has an air suction opening;

a lower casing; and a plurality of support members disposed between the lower casing and the upper casing, wherein air discharge openings are provided between the support members;

an impeller which is disposed in the casing between the upper casing and the lower casing, wherein the impeller comprises:

an annular upper shroud which is provided on an upper casing side;

a lower shroud;

a base plate that is arranged outside the lower shroud; and a plurality of blades which are arranged along a circumferential direction between the annular upper shroud and the base plate; and a fan motor configured to rotate the impeller, wherein an upper surface of the upper casing is provided with a first group of recesses and a second group of recesses, wherein the recesses belonging to the first group are arranged in a first area adjacent to a circumferential edge of the air suction opening and arranged to surround the air suction opening, wherein the recesses belonging to the second group are arranged in a second area adjacent to an outer circumferential edge of the first area and arranged to surround the first area, wherein each of the adjacent two of the recesses belonging to the first group are partitioned by a first radial rib that extends in a radial direction of the impeller, and wherein the first area and the second area are partitioned by a first circumferential rib that extends in a circumferential direction of the impeller.

2. The centrifugal fan according to claim 1, wherein an outside diameter of the base plate is substantially equal to an outside diameter of the annular upper shroud.

3. The centrifugal fan according to claim 1, wherein the annular upper shroud, the blades and the base plate are integrally formed.

4. The centrifugal fan according to claim 1, wherein the casing has a substantially flat box shape having four corners and four side faces, wherein the air discharge openings are provided at each of the four side faces.

5. The centrifugal fan according to claim 4, wherein the support members are provided at each of the four corners of the casing.

6. The centrifugal fan according to claim 4, wherein the air discharge openings are provided at each side faces of the casing and between two of the support members disposed at corner portions of the casing.

7. The centrifugal fan according to claim 1, wherein each of the adjacent two of the recesses belonging to the second group are partitioned by a second radial rib that extends in a radial direction of the impeller.

8. The centrifugal fan according to claim 7, wherein each of the recesses belonging to the second group is partitioned by the first circumferential rib, two of the second radial rib, and a second circumferential rib that extends in the circumferential direction of the impeller and is disposed at a position more distant from the air suction opening with respect to the first circumferential rib.

9. The centrifugal fan according to claim 1, wherein each of the recess belonging to the first group is partitioned by the upper surface of the upper casing, two of the first radial rib, and the first circumferential rib.

* * * * *